US008939522B2

(12) United States Patent
Wu

(10) Patent No.: US 8,939,522 B2
(45) Date of Patent: Jan. 27, 2015

(54) COVER OPENING-CLOSING DEVICE AND MULTI-FUNCTION PRINTER WITH THE SAME

(75) Inventor: Yen-Jui Wu, New Taipei (TW)

(73) Assignee: Kinpo Electronics, Inc., New Taipei (TW)

( * ) Notice: Subject to any disclaimer, the term of this patent is extended or adjusted under 35 U.S.C. 154(b) by 279 days.

(21) Appl. No.: 13/420,593

(22) Filed: Mar. 14, 2012

(65) Prior Publication Data

US 2013/0140971 A1 Jun. 6, 2013

(30) Foreign Application Priority Data

Dec. 5, 2011 (TW) ..... 100144641 A

(51) Int. Cl.
*A47B 81/00* (2006.01)

(52) U.S. Cl.
USPC ..... 312/223.2

(58) Field of Classification Search
USPC ..... 312/223.2, 319.5, 319.6, 319.7; 49/333, 49/334, 335, 337; 16/354; 399/21, 124, 399/125
See application file for complete search history.

(56) References Cited

U.S. PATENT DOCUMENTS

| | | | | |
|---|---|---|---|---|
| 3,470,653 | A * | 10/1969 | Kalog | 49/139 |
| 6,782,223 | B2 * | 8/2004 | Yoshida | 399/124 |
| 7,512,376 | B2 * | 3/2009 | Suzuki | 399/380 |
| 8,528,893 | B2 * | 9/2013 | Huang et al. | 271/10.04 |
| 2006/0180972 | A1 | 8/2006 | Suzuki | |
| 2007/0289099 | A1 * | 12/2007 | Jung | 16/354 |
| 2008/0034544 | A1 * | 2/2008 | Kuo | 16/354 |
| 2011/0089795 | A1 * | 4/2011 | Yoon | 312/319.7 |
| 2013/0091774 | A1 * | 4/2013 | Nagao et al. | 49/335 |
| 2014/0009874 | A1 * | 1/2014 | Huang | 361/679.01 |

FOREIGN PATENT DOCUMENTS

| | | |
|---|---|---|
| CN | 2459299 | 11/2001 |
| CN | 1706655 | 12/2005 |
| CN | 101075149 | 11/2007 |
| CN | 201033489 | 3/2008 |
| CN | 201287815 | 8/2009 |
| CN | 101749374 | 6/2010 |
| CN | 201889955 | 7/2011 |
| TW | I274592 | 3/2007 |
| TW | M349913 | 2/2009 |
| TW | M373357 | 2/2010 |

OTHER PUBLICATIONS

"Office Action of China Counterpart Application" , issued on Nov. 18, 2014, p. 1-13.

* cited by examiner

*Primary Examiner* — Daniel Rohrhoff
(74) *Attorney, Agent, or Firm* — Jianq Chyun IP Office

(57) ABSTRACT

A cover opening-closing device for opening or closing a cover relative to a base is provided. The cover opening-closing device includes an actuation module, a transmission module, and a rotating shaft. The actuation module is disposed on the base and between the base and the cover. The transmission module is engaged to the actuation module. The rotating shaft has a first end and an opposite second end. The first end is joggled to the actuation module, and the second end is connected to the cover. The actuation module drives the rotating shaft to rotate through the transmission module, so as to allow the cover connected to the rotating shaft to move to an open position or a close position relative to the base. Thereby, a user's time is saved and proper opening and closing of the cover is ensured. A multi-function printer with the cover opening-closing device is further provided.

22 Claims, 5 Drawing Sheets

COVER OPENING-CLOSING DEVICE AND MULTI-FUNCTION PRINTER WITH THE SAME

CROSS-REFERENCE TO RELATED APPLICATION

This application claims the priority benefit of Taiwan application serial no. 100144641, filed on Dec. 5, 2011. The entirety of the above-mentioned patent application is hereby incorporated by reference herein and made a part of this specification.

BACKGROUND OF THE INVENTION

1. Field of the Invention

The invention generally relates to a cover opening-closing device, and more particularly, to an automatic cover opening-closing device applicable in a multi-function printer (MFP).

2. Description of Related Art

In today's information age, office automation equipments (OAEs), such as scanner, photocopier, and printers, are usually setup in offices, and users can carry out various document processing operations by using such OAEs.

A lot of space will be taken if different OAEs are setup in the same office. Thus, multi-function printer (MFP) that combines the functions of photocopier, printer, and scanner is developed in order to save office space without sacrificing functionality.

Usually, paper jam may occur when a MFP is used for photocopying or printing. However, not every user knows how to lift up the cover of a MFP to resolve the paper jam problem. A user may have to spend some time on learning how to open up a cover, or the cover may be damaged if the user forcibly lifts up the cover. Besides, after the paper jam problem is resolved, the user needs to manually close the cover in order to carry out subsequent operations. However, if the user does not close the cover properly, the MFP will show a malfunction alarm and the subsequent operations cannot be performed. As a result, the user's time is wasted.

SUMMARY OF THE INVENTION

Accordingly, the invention is directed to a cover opening-closing device that can automatically open or close a cover relative to a base.

The invention is directed to a multi-function printer (MFP), in which a cover is automatically opened or closed relative to a base through sensing, so that a user can resolve a paper jam problem conveniently, and the cover can be properly closed after the paper jam problem is resolved.

The invention provides a cover opening-closing device suitable for opening or closing a cover relative to a base. The cover opening-closing device includes an actuation module, a transmission module, and a rotating shaft. The actuation module is disposed on the base and located between the base and the cover. The transmission module is engaged to the actuation module. The rotating shaft has a first end and an opposite second end, wherein the first end is joggled to the transmission module, and the second end is connected to the cover. When the actuation module works, it rotates the rotating shaft through the transmission module so as to allow the cover connected to the rotating shaft to move to an open position or a close position relative to the base.

The invention further provides a MFP including a base, a cover, and a cover opening-closing device. The cover is pivoted to the base, and the cover opening-closing device is disposed on the base and connected with the cover. The cover opening-closing device includes a sensing module, an actuation module, a transmission module, and a rotating shaft. The sensing module is disposed on at least one of the base and the cover and configured for sensing any situation that requires the cover to the opened or closed. The actuation module is electrically connected to the sensing module. The transmission module is engaged to the actuation module. The rotating shaft has a first end and an opposite second end, wherein the first end is joggled to the transmission module, and the second end is connected to the cover. When the sensing module senses a situation that requires the cover to be opened, it drives the actuation module to rotate the rotating shaft, so as to allow the cover connected to the rotating shaft to automatically move to an open position relative to the base. When the sensing module senses a situation that requires the cover to be closed, it drives the actuation module to rotate the rotating shaft, so as to allow the cover connected to the rotating shaft to automatically move to a close position relative to the base.

As described above, the invention provides a cover opening-closing device and a MFP, in which a cover is automatically opened or closed so that a user's time is saved and proper opening and closing of the cover is ensured.

These and other exemplary embodiments, features, aspects, and advantages of the invention will be described and become more apparent from the detailed description of exemplary embodiments when read in conjunction with accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
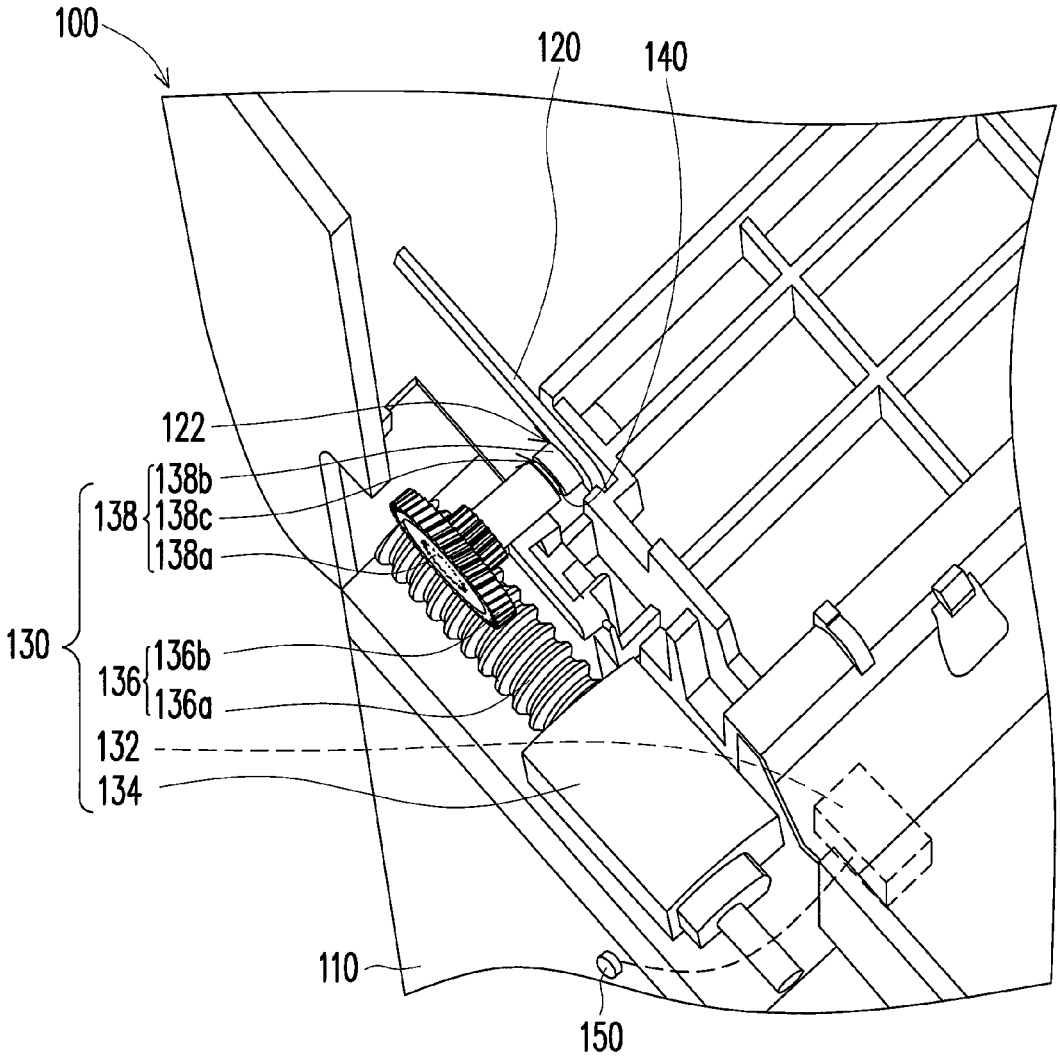
FIG. 1A is an enlarged view of a cover opening-closing device of a multi-function printer (MFP) according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 1B:
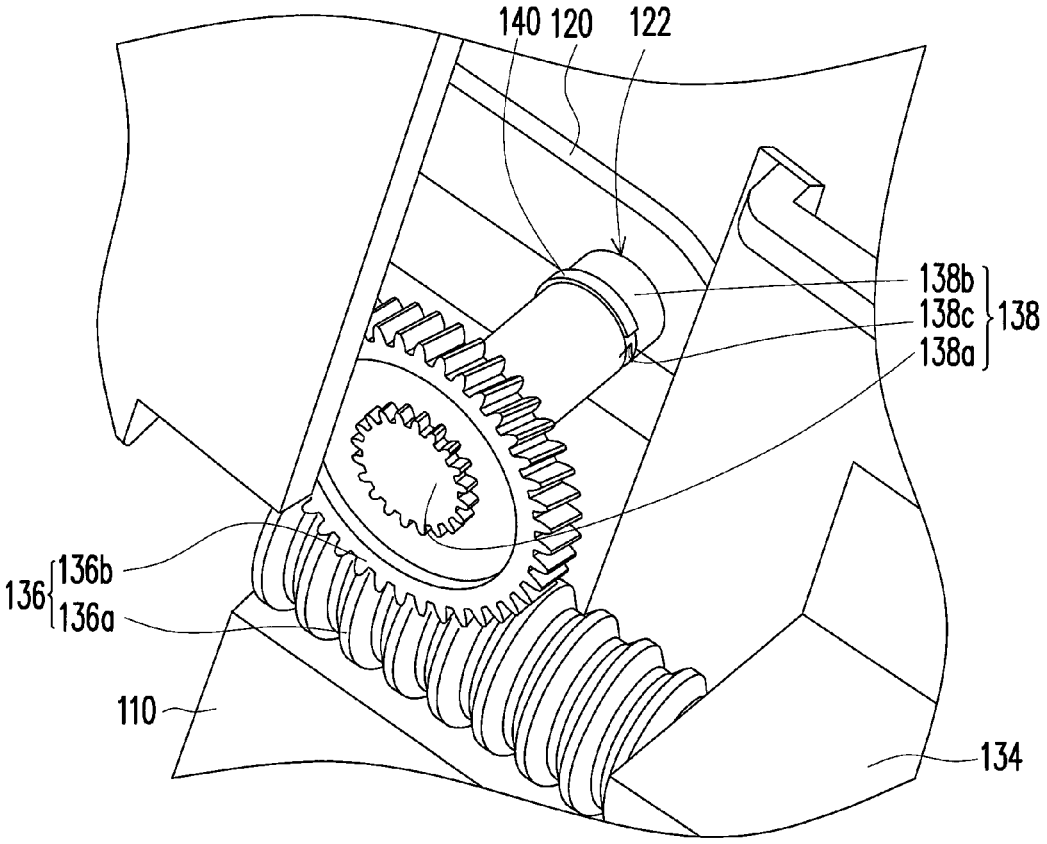
FIG. 1B is an enlarged partial view of the cover opening-closing device in FIG. 1A.

The invention provides a cover opening-closing device which can automatically open or close a cover. Herein an application of the cover opening-closing device to a multi-function printer (MFP) is taken as an example in order to describe the content of the invention clearly. FIG. 1A is an enlarged view of a cover opening-closing device of a multi-function printer (MFP) according to an embodiment of the invention. FIG. 1B is an enlarged partial view of the cover opening-closing device in FIG. 1A.

Referring to FIG. 1A and FIG. 1B, the MFP 100 in the present embodiment includes a base 110, a cover 120, a cover opening-closing device 130, a stopper 140, and an alarm 150. The cover 120 is pivoted to the base 110. The cover opening-closing device 130 is disposed on the base 110 and connected with the cover 120.

In the present embodiment, the cover opening-closing device 130 includes a sensing module 132, an actuation module 134, a transmission module 136, and a rotating shaft 138. The sensing module 132 is disposed on at least one of the base 110 and the cover 120. The actuation module 134 is electrically connected to the sensing module 132. In the present embodiment, the actuation module 134 is a coded motor such that the rotation route of the actuation module 134 can be controlled.

The transmission module 136 is engaged to the actuation module 134. The transmission module 136 in the present embodiment includes a rack 136*a* and a gear wheel 136*b*. The rack 136*a* is connected to the actuation module 134, and the gear wheel 136*b* is joggled to the rack 136*a*.

The rotating shaft 138 has a first end 138*a* and an opposite second end 138*b*. The first end 138*a* is joggled to the gear wheel 136*b* of the transmission module 136, and the second end 138*b* is connected to the cover 120. In the present embodiment, the cover 120 has a hole 122, and the second end 138*b* of the rotating shaft 138 is tightly fit into the hole 122. In the present embodiment, the second end 138*b* of the rotating shaft 138 is in a D shape, and the shape of the hole 122 is corresponding to that of the second end 138*b* so that the cover 120 and the rotating shaft 138 can move together. However, the connection between the rotating shaft 138 and the cover 120 is not limited in the invention, and the rotating shaft 138 and the cover 120 may also be joggled or screwed together.

In the present embodiment, in order to prevent the cover 120 from moving along the rotating shaft 138, the rotating shaft 138 has a groove 138*c* close to the second end 138*b*, and the stopper 140 is disposed at the groove 138*c*. Because the height of the stopper 140 is greater than the depth of the groove 138*c*, when the stopper 140 is disposed on the groove 138*c*, the stopper 140 protrudes from the surface of the rotating shaft 138 so that the cover 120 is prevented from moving along the rotating shaft 138. On the other hand, the groove 138*c* can prevent the stopper 140 from moving relative to the rotating shaft 138. In the present embodiment, the stopper 140 is a C-shaped ring. However, the invention is not limited thereto, and in other embodiments, the stopper 140 may also be integrally formed on the rotating shaft 138.

Additionally, when the cover of the MFP 100 needs to be opened, because a user's manual interference is required to resolve any malfunction problem, in the present embodiment, the alarm 150 is adopted for informing the user to confirm the status of the MFP 100. In the present embodiment, the alarm 150 is disposed on the base 110 and electrically connected to the sensing module 132. The alarm 150 may be a speaker for giving off an alarm sound or a light source for emitting light. In other embodiments, the alarm 150 may also be disposed on the cover 120.

Figure 1C:
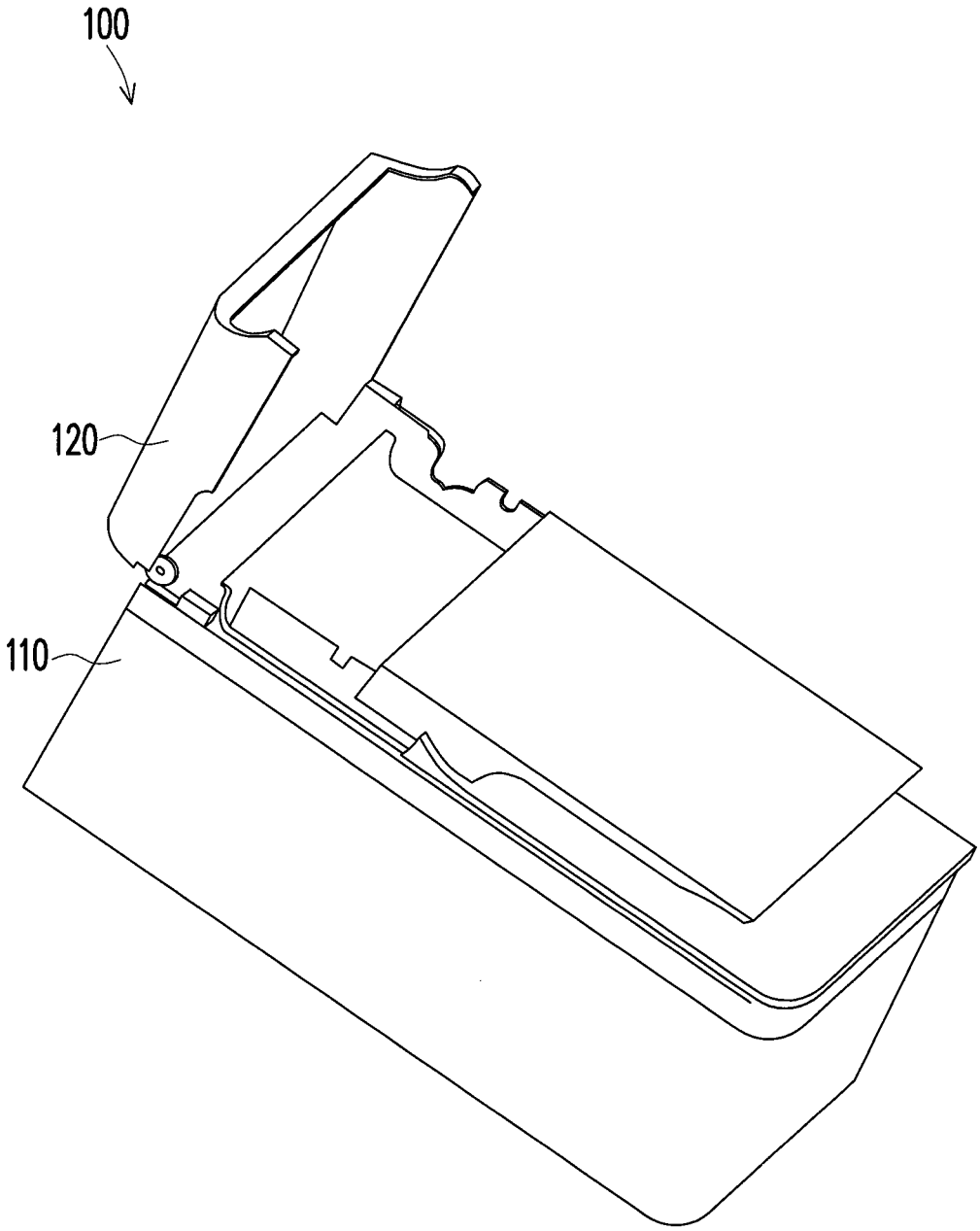
FIG. 1C is a diagram illustrating a cover of the MFP in FIG. 1A at an open position.
Figure 1D:
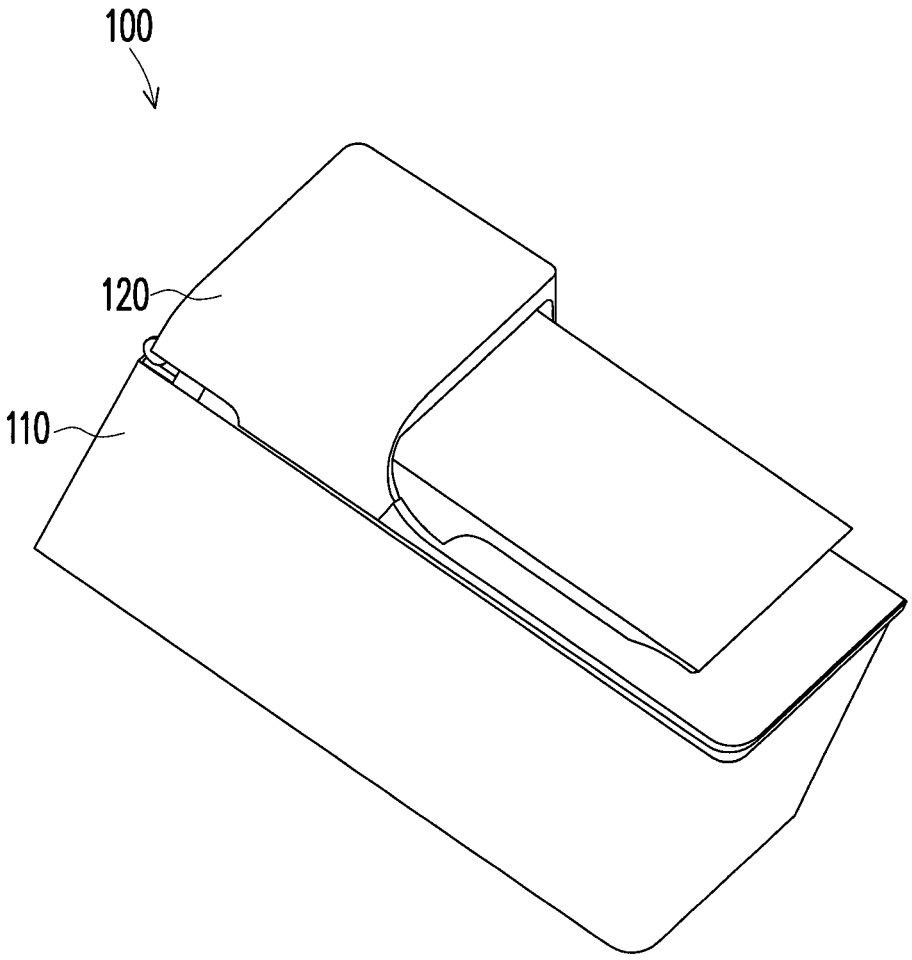
FIG. 1D is a diagram illustrating the cover of the MFP in FIG. 1A at a close position.

FIG. 1C is a diagram illustrating a cover of the MFP in FIG. 1A at an open position. FIG. 1D is a diagram illustrating the cover of the MFP in FIG. 1A at a close position. Referring to FIG. 1A, FIG. 1C, and FIG. 1D at the same time, in the present embodiment, the sensing module 132 is a contact image sensor used for detecting paper jam in the MFP 100. When the sensing module 132 senses a situation that requires the cover to be opened (for example, a paper jam), the sensing module 132 issues a signal such that the actuation module 134 actuates the transmission module 136 and accordingly the rotating shaft 138 connected to the transmission module 136 drives the cover 120 to automatically move to an open position P1 relative to the base 110 (as shown in FIG. 1C). Besides, the sensing module 132 also sends a signal to the alarm 150 so that the alarm 150 can give off a sound or emit light to inform the user that a malfunction problem needs to be resolved on the MFP 100.

After the user resolves the malfunction problem (for example, the jammed paper is released), the sensing module 132 senses the situation that the cover needs to be closed and issues a signal to the actuation module 134 to actuate the rotating shaft 138, so that the cover 120 automatically moves to a close position P2 relative to the base 110 (as shown in FIG. 1D). Besides, the sensing module 132 also sends a signal to the alarm 150 to stop the alarm 150. However, the user may also manually stop the alarm 150 when the user resolves the malfunction problem on the MFP 100.

However, the function of the sensing module 132 is not limited to that described above, and in other embodiments, the sensing module 132 may also be configured to, sense the quantity of toner, so as to determine whether the cover 120 needs to be opened (for example, the weight of toner is lower than a standard value) or closed (for example, the weight of toner is higher than the standard value) relative to the base 110.

Figure 2:
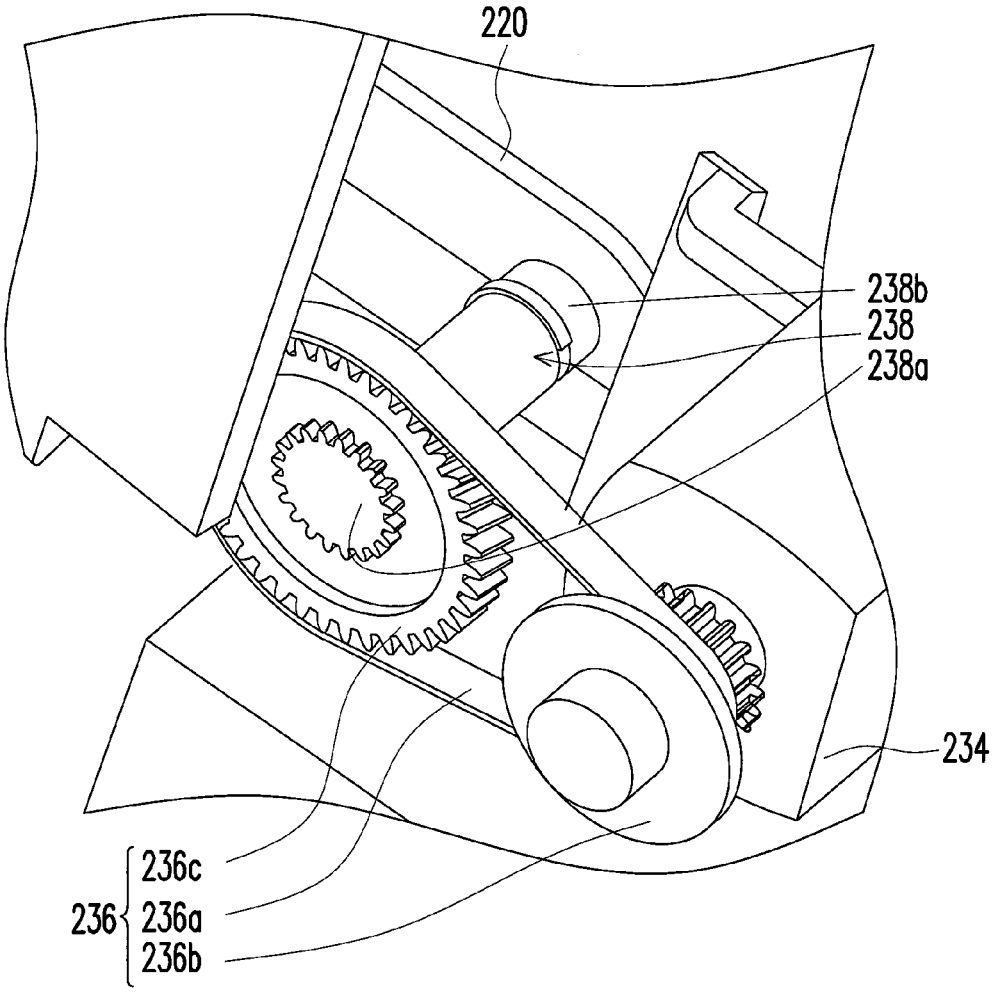
FIG. 2 is an enlarged partial view of a cover opening-closing device of a MFP according to another embodiment of the invention.

FIG. 2 is an enlarged partial view of a cover opening-closing device of a MFP according to another embodiment of the invention. Referring to FIG. 2, in order to clearly described the difference between the embodiment in FIG. 2 and the embodiment in FIG. 1A, the base of the MFP is not illustrated in FIG. 2.

The difference between the embodiment in FIG. 2 and the embodiment in FIG. 1A falls on the type of the transmission module. As shown in FIG. 2, the transmission module 236 includes a belt 236*a*, a first pulley 236*b*, and a second pulley 236*c*. The first pulley 236*b* is disposed at the actuation device 234 and rotates along with the actuation device 234. The second pulley 236*c* is joggled to the first end 238*a* of the rotating shaft 238. The belt 236*a* is looped over the first pulley 236*b* and the second pulley 236*c*. The actuation device 234 drives the first pulley 236*b* to run the belt 236*a* clockwise or anticlockwise, so as to drive the second pulley 236*c* to rotate. The rotating shaft 238 rotates along with the second pulley 236*c* so that the cover 220 connected to the second end 238*b* can move to an open position or a close position relative to a base (not shown). However, the type of the transmission module is not limited to that described above, and in other embodiments, different types of transmission modules can be adopted as long as the operation of an actuation device can be conveyed to a rotating shaft to open or close a cover.

As described above, in a cover opening-closing device provided by the invention, a sensing module senses a situation that requires a cover to be opened or closed and issues a corresponding signal to an actuation module to activate the actuation module, and the cover is automatically opened or closed through a transmission module and a rotating shaft. Besides, the sensing module also sends a signal to an alarm to inform a user about the situation. The cover opening-closing device in the invention can save the user's time by automatically opening or closing the cover, ensure that the cover is properly opened or closed, and moreover, promptly inform the user about any malfunction so that the malfunction can be resolved as soon as possible.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A cover opening-closing device, applying for opening or closing a cover relative to a base, the cover opening-closing device comprising:

an actuation module, disposed on the base and between the base and the cover;

a transmission module, connected to the actuation module;

a rotating shaft, having a first end and an opposite second end, wherein the first end is joggled to the transmission module, and the second end is connected to the cover, wherein when the actuation module works, the actuation module rotates the rotating shaft through the transmission module so as to allow the cover connected to the rotating shaft to move to an open position or a close position relative to the base, a sensing module, electrically connected to the actuation module, configured to sense a situation that requires the cover to be opened or closed and drive the actuation module to allow the cover to automatically move to the open position or the close position relative to the base; and an alarm, disposed on the base or the cover, electrically connected to the sensing module, wherein when the sensing module senses the situation that requires the cover to be opened, the sensing module drives the alarm to operate.

2. The cover opening-closing device according to claim 1, wherein the cover has a hole, and the second end of the rotating shaft is tightly fit into the hole.

3. The cover opening-closing device according to claim 2, wherein the rotating shaft further has a groove located close to the second end.

4. The cover opening-closing device according to claim 3 further comprising:

a stopper, disposed at the groove, wherein a height of the stopper is greater than a depth of the groove so that the cover is prevented from moving along the rotating shaft.

5. The cover opening-closing device according to claim 4, wherein the stopper is a C-shaped ring.

6. The cover opening-closing device according to claim 2, wherein a shape of the second end of the rotating shaft is a D shape, and a shape of the hole is corresponding to the shape of the second end.

7. The cover opening-closing device according to claim 1, wherein the actuation module is a coded motor.

8. The cover opening-closing device according to claim 1, wherein the transmission module comprises:

a rack, connected to the actuation module, and driven by the actuation module to rotate; and a gear wheel, fitted to the first end of the rotating shaft, and joggled with the rack to be driven by the rack to rotate.

9. The cover opening-closing device according to claim 1, wherein the transmission module comprising:

a first pulley, disposed at the actuation module, and driven by the actuation module to rotate;

a second pulley, fitted to the first end; and a belt, looped over the first pulley and the second pulley.

10. The cover opening-closing device according to claim 1, wherein the sensing module is a contact image sensor.

11. The cover opening-closing device according to claim 1, wherein the alarm is a speaker or a light source.

12. A multi-function printer (MFP), comprising:

a base;

a cover, pivoted to the base;

a cover opening-closing device, disposed on the base and connected with the cover, the cover opening-closing device comprising:

a sensing module, disposed on at least one of the base and the cover, configured to sense a situation that requires the cover to be opened or closed;

an actuation module, electrically connected to the sensing module;

a transmission module, engaged to the actuation module;

a rotating shaft, having a first end and an opposite second end, wherein the first end is joggled to the transmission module, and the second end is connected to the cover, wherein when the sensing module senses the situation that requires the cover to be opened, the sensing module drives the actuation module to rotate the rotating shaft and allow the cover connected to the rotating shaft to automatically move to an open position relative to the base, when the sensing module senses the situation that requires the cover to be closed, the sensing module drives the actuation module to rotate the rotating shaft and allow the cover connected to the rotating shaft to automatically move to a close position relative to the base; and an alarm, disposed on the base or the cover, electrically connected to the sensing module, wherein when the sensing module senses the situation that requires the cover to be opened, the sensing module drives the alarm to operate.

13. The MFP according to claim 12, wherein the cover has a hole, and the second end of the rotating shaft is tightly fit into the hole.

14. The MFP according to claim 13, wherein the rotating shaft further has a groove located close to the second end.

15. The MFP according to claim 14 further comprising:

a stopper, disposed at the groove, wherein a height of the stopper is greater than a depth of the groove so that the cover is prevented from moving along the rotating shaft.

16. The MFP according to claim 15, wherein the stopper is a C-shaped ring.

17. The MFP according to claim 13, wherein a shape of the second end of the rotating shaft is a D shape, and a shape of the hole is corresponding to the shape of the second end.

18. The MFP according to claim 12, wherein the actuation module is a coded motor.

19. The MFP according to claim 12, wherein the transmission module comprises:

a rack, connected to the actuation module, and driven by the actuation module to rotate; and a gear wheel, fitted to the first end of the rotating shaft, and joggled with the rack to be driven by the rack to rotate.

20. The MFP according to claim 12, wherein the transmission module comprises:

a first pulley, disposed at the actuation module, and driven by the actuation module to rotate;

a second pulley, fitted to the first end; and a belt, looped over the first pulley and the second pulley.

21. The MFP according to claim 12, wherein the sensing module is a contact image sensor.

22. The MFP according to claim 12, wherein the alarm is a speaker or a light source.

* * * * *